US008084723B2

(12) United States Patent
Kruempelmann et al.

(10) Patent No.: US 8,084,723 B2
(45) Date of Patent: Dec. 27, 2011

(54) METHOD FOR DETECTING A FIRE CONDITION IN A COOKING CHAMBER OF A BAKING OVEN

(75) Inventors: Thomas Kruempelmann, Guetersloh (DE); Juergen Scharmann, Herzebrock-Clarholz (DE); Ulrich Sillmen, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 1152 days.

(21) Appl. No.: 11/848,892

(22) Filed: Aug. 31, 2007

(65) Prior Publication Data

US 2008/0053990 A1 Mar. 6, 2008

(30) Foreign Application Priority Data

Sep. 4, 2006 (DE) ..... 10 2006 041 767

(51) Int. Cl.
*H05B 6/50* (2006.01)

(52) U.S. Cl. ..... 219/707; 219/490; 219/497

(58) Field of Classification Search ..... 219/490, 219/489, 492, 497, 704, 705, 707; 99/325–333; 165/200

See application file for complete search history.

(56) References Cited

U.S. PATENT DOCUMENTS

| | | | | |
|---|---|---|---|---|
| 4,481,404 | A | 11/1984 | Thomas et al. | |
| 4,496,817 | A | 1/1985 | Smith | |
| 4,954,694 | A | 9/1990 | Nagai et al. | |
| 7,075,041 | B2 | 7/2006 | Kruempelmann et al. | |
| 7,182,287 | B2 * | 2/2007 | Denker et al. | 242/533.3 |
| 2001/0052852 | A1 | 12/2001 | Kouznetsov et al. | |
| 2002/0014480 | A1 | 2/2002 | Corda et al. | |

FOREIGN PATENT DOCUMENTS

| | | |
|---|---|---|
| DE | 19850564 | 5/2000 |
| DE | 10327861 | 1/2005 |
| WO | WO-2004076928 | 9/2004 |

* cited by examiner

*Primary Examiner* — Quang Van
(74) *Attorney, Agent, or Firm* — Leydig, Voit & Mayer, Ltd.

(57) ABSTRACT

A method for detecting a fire condition in a cooking chamber of a baking oven. The method includes measuring the oxygen concentration in the baking oven and also using an evaluation circuit of an electronic controller to determine the rate of change of the oxygen. The oxygen concentration and the rate of change are compared to predetermined values stored in a memory of the electronic controller. If the oxygen concentration reaches a value smaller than a limit in the range of 15 to 20 percent by volume, and the rate of change of the oxygen concentration exceeds a rate of decrease of about 2.5 percent by volume per 10 seconds, the fire condition is detected. Subsequently an alarm is created and/or at least one of the heat output or air circulation through the oven is reduced.

17 Claims, 2 Drawing Sheets

METHOD FOR DETECTING A FIRE CONDITION IN A COOKING CHAMBER OF A BAKING OVEN

Priority is claimed to German patent application DE 10 2006 041 767.4, filed Sep. 4, 2006, and which is hereby incorporated by reference herein.

The present invention relates to a method for detecting a fire condition in a cooking chamber of a baking oven.

BACKGROUND

U.S. Pat. No. 4,496,817 describes a cooking process that is divided into three phases, namely a normal cooking phase, a drying out phase, and a pre-combustion phase. At the beginning of the normal cooking phase, the concentration of organic gases, such as carbon dioxide or carbon monoxide, in the cooking chamber is relatively low. As the cooking chamber continues to be heated, the concentration of organic gases increases rapidly. Normal cooking processes should be terminated prior to reaching this point.

At times, this point may be exceeded, for example, due to user errors, so that the cooking chamber continues to be heated. As a result, the temperature of the food load in the cooking chamber continues to rise while the gas concentration increases only very slowly. This phase is referred to as the drying out phase. Before the temperature of the food load reaches a point where the food load ignites, the food begins to char, resulting in another sharp increase in the concentration of organic gases in the cooking chamber. This phase is referred to as the pre-combustion phase.

To ensure safety in the event of a user error, U.S. Pat. No. 4,496,817 describes a method in which in order to distinguish the individual phases, the system measures the concentration of an organic gas, such as carbon dioxide or carbon monoxide, in the cooking chamber.

Once the gas concentration exceeds a predetermined threshold, the controller of the baking oven detects that the normal cooking phase has ended, and that now the current cooking process is in the so-called drying out phase. After that, the rate of change of the gas concentration is monitored and compared to predetermined limit values in an evaluation circuit of the controller. If the rate of change falls below a lower limit, then the controller detects a transition from the normal and desired cooling at the end of the normal cooking phase to the drying out phase. If subsequently the rate of change of the gas concentration increases sharply again and exceeds an upper limit, then the system detects the beginning of the pre-combustion phase.

In order to prevent flaming in the cooking chamber, and thus to prevent a fire condition, the U.S. Pat. No. 4,496,817 proposes that a magnetron for heating the cooking chamber and a blower for circulating air through the cooking chamber be switched off. It is also proposed to generate an audible alarm signal.

U.S. Pat. No. 4,954,694 describes a method for controlling a pyrolytic cleaning process, in which the oxygen concentration in the cooking chamber is measured by an oxygen sensor, and the rate of change of the measured oxygen concentration is evaluated. The overall heating time required is determined from the curve of the rate of change. However, it does not describe the detection of a fire condition.

U.S. Pat. No. 4,481,404 and U.S. Patent Application No. 2002/0014480 each describe a method for pyrolytic cleaning, but do not disclose any fire condition detection either.

Furthermore, U.S. Patent Application No. 2001/0052852 generally describes the control of cooking processes as a function of the concentration of smoke or gas.

Finally, German Patent Application No. DE 103 27 861 A1 describes the use of a cooking quotient for controlling a cooking process, the cooking quotient being calculated from a current rate of change of the oxygen concentration and a first extreme value determined for the rate of change. However, it does not describe the detection of a fire condition.

SUMMARY

It is an object of the present invention to provide a method for detecting a fire condition in a cooking chamber of a baking oven, which requires less complex circuitry and reduces the amount of computing power required of the electric controller of the baking oven, and which can also be used during pyrolytic cleaning processes in baking ovens.

In an embodiment, the present invention provides a method for detecting a fire condition in a cooking chamber of a baking oven. The method includes measuring the oxygen concentration in the baking oven and also using an evaluation circuit of an electronic controller to determine the rate of change of the oxygen. The oxygen concentration and the rate of change are compared to predetermined values stored in a memory of the electronic controller. If the oxygen concentration reaches a value smaller than a limit in the range of 15 to 20 percent by volume, and the rate of change of the oxygen concentration exceeds a rate of decrease of about 2.5 percent by volume per 10 seconds, an alarm is created.

In another embodiment, the present invention provides a method for detecting a fire condition in a cooking chamber of a baking oven. The method includes measuring the oxygen concentration in the baking oven and also using an evaluation circuit of an electronic controller to determine the rate of change of the oxygen. The oxygen concentration and the rate of change are compared to predetermined values stored in a memory of the electronic controller. If the oxygen concentration reaches a value smaller than a limit in the range of 15 to 20 percent by volume, and the rate of change of the oxygen concentration exceeds a rate of decrease of about 2.5 percent by volume per 10 seconds, at least one of the heat output of the cooking oven's heating element or the air flow through the cooking oven is reduced.

BRIEF DESCRIPTION OF THE DRAWINGS

An exemplary embodiment of the present invention is shown in the drawings in a purely schematic way and will be described in more detail below. In the drawings.

DETAILED DESCRIPTION

The present invention provides a reduction in the complexity of the circuitry and in the amount of computing power required of the electric controller of the baking oven, and also the possibility of using the method during pyrolytic cleaning processes in baking ovens. Moreover, the measurement and evaluation of the oxygen concentration in the cooking chamber allows high accuracy and reproducibility of the values measured using the method according to the present invention, and thus of the inventive method, since the amount of oxygen present in the cooking chamber is large enough during the entire cooking process or pyrolytic cleaning process to ensure a reliable measurement.

The specified range of values for the oxygen concentration limit ensures rapid and early detection of a dangerous situation prior to the actual occurrence of a fire in the cooking chamber. Laboratory tests performed showed that it is advantageous to use a limit of 18 percent by volume (abbreviated "vol. percent") in one embodiment. Additionally, the limit for the rate of change of the oxygen concentration provides protection against false alarms and erroneous shutdown of the cooking chamber heating element or of the air circulation through the cooking chamber. Such malfunctions could occur if the limit selected for the rate of change of the oxygen concentration is too low. Unavoidable variance in the measured values, and unavoidable changes caused, for example, by steam released from the food, or, during the pyrolysis cycle, by the pyrolysis of the soils which have accumulated on the walls of the cooking chamber, could then lead to unwanted and false detection of a fire condition.

Figure 1:
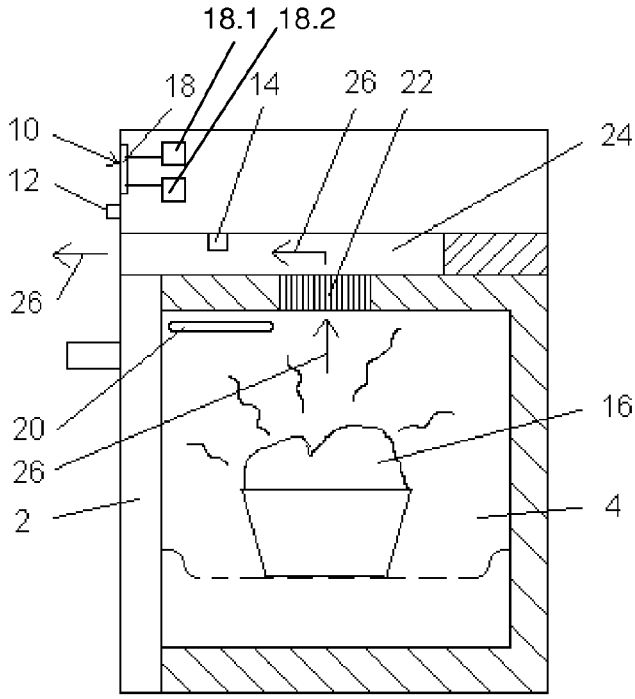
FIG. 1 is a view showing a baking oven for carrying out a method according to the present invention.

FIG. 1 shows a baking oven for carrying out the method according to the present invention. The baking oven includes a cooking chamber 4 which is closable by a door 2 and further includes a control panel 10, which is provided with a display and control elements 12.

Food 16 placed on a food-supporting member is inserted in cooking chamber 4. Further, the baking oven has an electronic controller 18, which contains an evaluation circuit 18.1 with a timer and a memory 18.2 and is in signal communication with an oxygen sensor 14 located in a vapor duct 24 and with a cooking chamber heating element 20 in the form of a resistance heater.

When the baking oven is in operation, the vapors are removed from cooking chamber 4 through a catalyst 22 and vapor duct 24 in a manner known to those skilled in the art. This is symbolized by arrows 26. Thus, oxygen sensor 14 detects an instantaneous oxygen concentration, since the gases formed during the cooking process, or by pyrolysis during a pyrolytic cleaning process, are continuously removed from cooking chamber 4. These gases do not concentrate in cooking chamber 4.

The method according to the present invention is not limited to baking ovens having a catalyst 22.

If the baking oven is provided with a catalyst 22, as explained earlier for the present exemplary embodiment, it is generally advantageous to place oxygen sensor 14 downstream of the catalyst 22 in the direction of flow since the output signal of oxygen sensor 14 transmitted to the evaluation circuit is thereby amplified. This is the case because the oxidizable gas molecules escaping from food 16 are oxidized by the action of catalyst 22, and the number of gas molecules that displace the oxygen is thereby increased downstream of catalyst 22. In the process, oxygen is consumed. Thus, the oxygen concentration is reduced to a greater extent than when the sensor 14 is installed upstream of catalyst 22 in the direction of flow, for example, when installed in cooking chamber 4. Because of this, it is possible to use an oxygen sensor 14 that is less sensitive and therefore less expensive.

Figure 2:
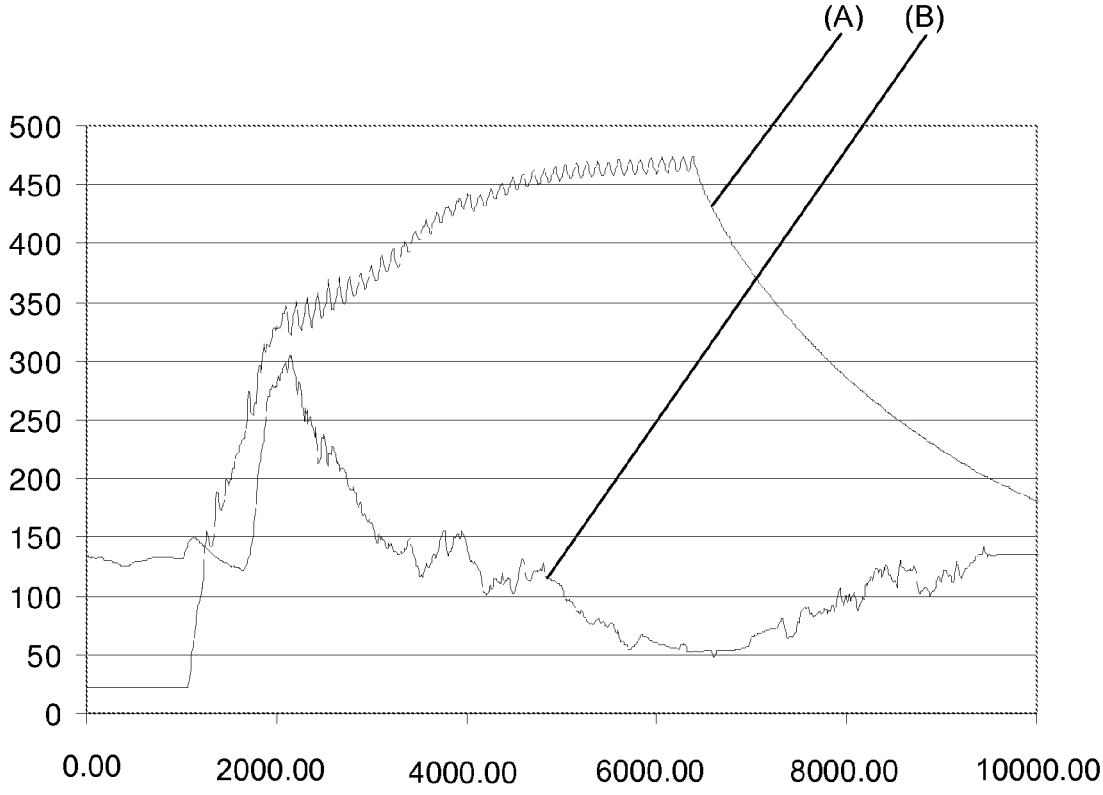
FIG. 2 shows a first diagram, in which the cooking chamber temperature and the quantity (1 minus the oxygen concentration), abbreviated "$(1-O_2)$", are plotted as a function of the pyrolysis time.

FIG. 2 is an exemplary profile showing the cooking chamber temperature, curve (A), and the quantity $(1-O_2)$, curve (A), as a function of the pyrolysis time in seconds (abbreviated "s"). The labeling of the ordinate represents the cooking chamber temperature in ° C. The profile of quantity $(1-O_2)$ is shown only qualitatively. The ordinate is unlabeled. At the beginning of the pyrolysis process (0 s) shown here by way of example, cooking chamber temperature (A) is equal to room temperature; i.e., about 20° C. When the pyrolytic cycle is selected in order to remove unwanted soils from cooking chamber 4, in particular from the walls of the cooking chamber, cooking chamber temperature (A) is increased during the pyrolytic cycle according to a predetermined pattern stored in memory 18.2 of electric controller 18. After pyrolysis is completed, cooking chamber temperature (A) is decreased. The profile of cooking chamber temperature (A) during the porylytic cycle can be completely predetermined and stored. Alternatively, the profile of cooking chamber temperature (A) during the pyrolytic cycle may also be automatically adjusted, in each individual case, according to parameters measured during the pyrolytic cycle, such as the oxygen concentration, in order to, for example, limit the generation of smoke.

At the beginning of the pyrolytic cycle described earlier, the profile of the oxygen concentration measured by oxygen sensor 14 starts at the value of the ambient air; i.e., at about 21 vol. percent. The oxygen concentration varies during the pyrolytic cleaning process. In the profile shown here by way of example, quantity $(1-O_2)$ increases sharply after a while, and then decreases until the initial oxygen concentration of about 21 vol. percent is reached at the end of the pyrolytic cleaning process.

Figure 3:
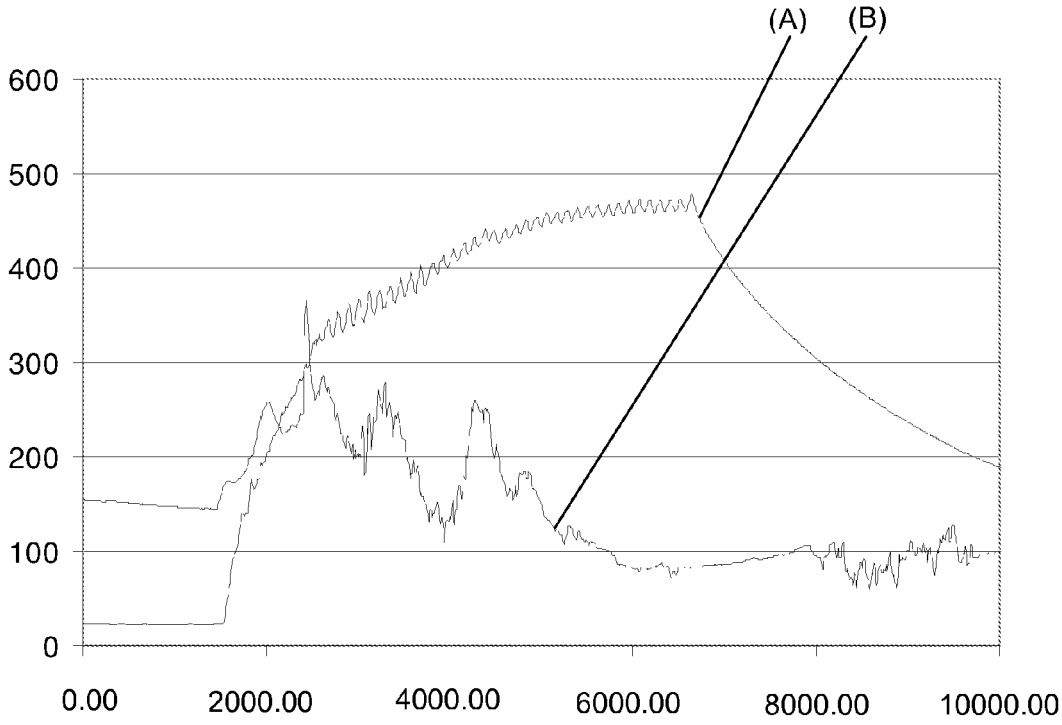
FIG. 3 is a second diagram analogous to that of FIG. 2, showing another exemplary profile.

Analogous to FIG. 2, FIG. 3 shows another exemplary profile of cooking chamber temperature a and quantity $(1-O_2)$, curve (B).

Unlike the profile of $(1-O_2)$ in FIG. 2, the increase of the value of $(1-O_2)$ between 2400 s and 2500 s is so large here that the rate of decrease of the oxygen concentration exceeds the further limit of about 2.5 vol. percent per 10 s. At the same time, quantity $(1-O_2)$ is so high that the oxygen concentration falls below the present limit of 18 vol. percent. Therefore, both conditions are met to cause a visual and audible alarm to be issued to the user via the display and a speaker of the baking oven, and to reduce the heat output of the cooking chamber heating element 20 and reduce the air circulation through the cooking chamber. By shutting down cooking chamber heating element 20 or reducing the heat output thereof, the food load, or the soils, are no longer heated, so that a fire condition is effectively prevented, or a beginning fire is stopped before it can grow. Shutting down or reducing the air circulation through the cooking chamber will suffocate an already existing fire.

Figure 4:
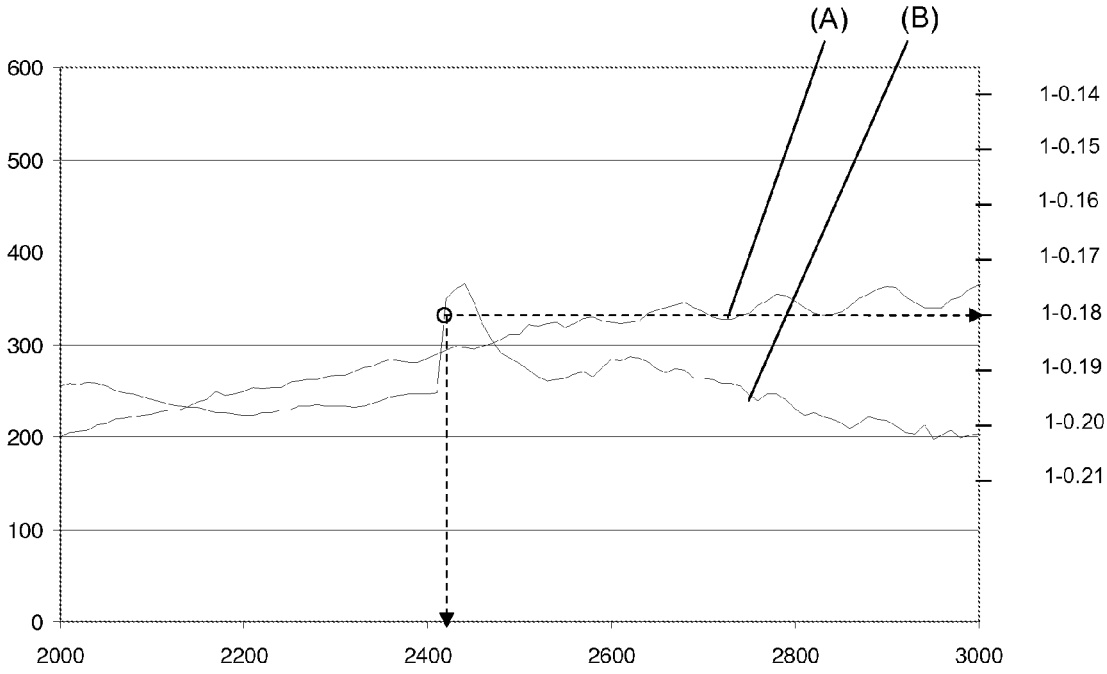
FIG. 4 shows a third diagram analogous to FIG. 3, in which the time axis is stretched.

FIG. 4 shows the time interval from 2000 s to 3000 s from FIG. 3; i.e., the time axis has been stretched accordingly. The abscissa is the time axis, the left ordinate indicates the cooking chamber temperature, and the right ordinate shows the quantity $(1-O_2)$. Clearly visible is the difference between a permissible increase in the value of $(1-O_2)$; i.e., the normal case, and an undesired increase of $(1-O_2)$; i.e., the case where the rate of decrease of the oxygen concentration exceeds the further limit of about 2.5 vol. percent per 10 s. The point at which both conditions are satisfied, namely that the measured oxygen concentration reaches a value smaller than a limit in the range from 15 to 20 vol. percent and, at the same time, the rate of decrease of the oxygen concentration exceeds a further limit of about 2.5 vol. percent per 10 s, is marked by a circle in curve (B). A fire condition can be reliably detected based on this distinct difference.

Alternatively, it would also be possible to only cause a visual and/or audible alarm to be issued to the user. Alternatively or additionally, it is also conceivable either to shut down the cooking chamber heating element, or reduce the heat output thereof, or to shut down or reduce the air circulation through the cooking chamber, for example by means of a fan, or in another manner known to those skilled in the art.

In addition, other values in the range from about 15 vol. percent to about 20 vol. percent could also be used as the limit.

The method of the present invention is not limited to the exemplary embodiment described herein. For example, it would also be possible to use it in baking ovens which do not have a pyrolytic cleaning function, or to use it during a cooking process, and thus at low cooking chamber temperatures.

What is claimed is:

1. A method for detecting a fire condition in a cooking chamber of a baking oven, comprising:

measuring an oxygen concentration in the baking oven;

determining a rate of change of the oxygen concentration in an evaluation circuit of an electronic controller of the baking oven;

comparing the measured oxygen concentration and the determined rate of change of the oxygen concentration to respective predetermined limit values stored in a memory of the electronic controller;

detecting a fire condition when the measured oxygen concentration reaches a value smaller than a first limit of the predetermined limit values and at the same time when the determined rate of change of the oxygen concentration exceeds a second limit of the predetermined limit values, the first limit being in a range of 15 to 20 percent by volume, the second limit being a rate of decrease limit being of about 2.5 percent by volume per 10 seconds; and upon the detecting of the fire condition, providing an alarm.

2. The method recited in claim 1 further comprising initiating a pyrolytic cleaning process, and wherein the measuring of the oxygen concentration is carried out during the pyrolytic cleaning process.

3. The method recited in claim 1 further comprising initiating a cooking process, and wherein the measuring of the oxygen concentration is carried out during the cooking process.

4. The method recited in claim 1 wherein the oxygen concentration is measured in the cooking chamber of the baking oven.

5. The method recited in claim 1 wherein the oxygen concentration is measured in a vapor duct in fluid communication with the cooking chamber of the baking oven.

6. The method recited in claim 1 wherein the measuring the oxygen concentration is preformed continuously.

7. The method recited in claim 1 wherein the measuring the oxygen concentration is performed discontinuously.

8. The method recited in claim 1 wherein the alarm is an audible alarm.

9. The method recited in claim 1 wherein the alarm is an audible and visual alarm.

10. The method recited in claim 1 further comprising reducing, upon the detecting of the fire condition, at least one of a heat output of a heating element in the cooking chamber and an air circulation through the cooking chamber.

11. A method for detecting a fire condition in a cooking chamber of a baking oven, comprising:

measuring an oxygen concentration in the baking oven;

determining a rate of change of the oxygen concentration in an evaluation circuit of an electronic controller of the baking oven;

comparing the measured oxygen concentration and the determined rate of change of the oxygen concentration to respective predetermined limit values stored in a memory of the electronic controller;

detecting a fire condition when the measured oxygen concentration reaches a value smaller than a first limit of the predetermined limit values and at the same time when the determined rate of change of the oxygen concentration exceeds a second limit of the predetermined limit values, the first limit being in a range of 15 to 20 percent by volume, the second limit being a rate of decrease limit being of about 2.5 percent by volume per 10 seconds; and upon the detecting of the fire condition, reducing at least one of a heat output of a heating element in the cooking chamber and an air circulation through the cooking chamber.

12. The method recited in claim 11 further comprising initiating a pyrolytic cleaning process, and wherein the measuring of the oxygen concentration is carried out during the pyrolytic cleaning process.

13. The method recited in claim 11 further comprising initiating a cooking process, and wherein the measuring of the oxygen concentration is carried out during the cooking process.

14. The method recited in claim 11 wherein the oxygen concentration is measured in the cooking chamber of the baking oven.

15. The method recited in claim 11 wherein the oxygen concentration is measured in a vapor duct in fluid communication with the cooking chamber of the baking oven.

16. The method recited in claim 11 wherein the measuring the oxygen concentration is performed continuously.

17. The method recited in claim 11 wherein the measuring the oxygen concentration is performed discontinuously.

* * * * *